United States Patent [19]

Morgan

[11] 3,998,330

[45] Dec. 21, 1976

[54] SIZING APPARATUS

[76] Inventor: Arthur H. Morgan, 4622 Hilltop Road, SW., Knoxville, Tenn. 37920

[22] Filed: Dec. 10, 1975

[21] Appl. No.: 639,424

[52] U.S. Cl. ..... 209/91; 209/102

[51] Int. Cl.[2] ..... B07B 1/15

[58] Field of Search ..... 209/91, 90, 102, 73

[56] References Cited

UNITED STATES PATENTS

| | | | |
|---|---|---|---|
| 1,735,795 | 11/1929 | Robbins | 209/102 |
| 2,630,224 | 3/1953 | Kinnebrew | 209/91 |

FOREIGN PATENTS OR APPLICATIONS

| | | | |
|---|---|---|---|
| 557,732 | 6/1957 | Belgium | 209/102 |

*Primary Examiner*—Allen N. Knowles
*Attorney, Agent, or Firm*—Fitch, Even, Tabin & Luedeka

[57] ABSTRACT

An apparatus for separating objects according to size including conveyor means having an endless conveyor belt trained over a supporting surface and mounted on a frame with its transverse dimension disposed at a slope to the horizontal. A plurality of endless sizing belts are arranged in side-by-side, spaced apart relationship with each sizing belt including a run which extends above and longitudinally of the supporting surface. The distance between the sizing belt runs and the supporting surface varies from a maximum distance adjacent the uppermost edge of the conveyor means to a minimum distance adjacent the lowermost edge of the conveyor means. Means are provided for driving the conveyor belt means and the plurality of sizing belt means to the end that objects placed on the sizing apparatus adjacent the uppermost edge of the conveyor means are sorted according to size and discharged from the opposite end of the supporting surface at a location varying according to size. A plurality of discharge channels are located transversely across one end of the conveyor belt means for collecting the discharged objects according to size.

7 Claims, 4 Drawing Figures

SIZING APPARATUS

This invention relates in general to apparatus for sizing objects and more particularly to apparatus adapted for sorting or grading produce such as fruits and vegetables.

Objects such as certain types of produce, e.g. citrus fruits, apples, peppers, tomatoes and the like, are graded according to size by growers and distributors prior to marketing. During sizing operations, it is desirable that the handling of the produce minimize bruising. For production reasons it is also desirable that the sorting or grading be done rapidly.

One known apparatus for sorting or grading vegetables involves the process of depoiting the produce into a sloped V-shaped crevice defined by an upper belt which moves transversely to the direction of a cooperating lower belt. The produce falls into the crevice under the force of gravity until trapped between the belts at a location where the spacing between the belts is commensurate with dimensions of the units. The lower belt then conveys the units through the crevice along a path transverse to the direction of movement of the cooperating belt and discharges them from the end of the conveyor at locations varying with size.

Another known apparatus for separating produce according to size operates on the principle of rolling the units down a pair of diverging rails or the like to the point where the units fall between the rails into a receiving bin.

These and other prior methods and apparatus used for separating fruits and vegetables according to size tend to damage or bruise the sorted produce, particularly where the surface of the fruit or vegetable is worked or where they are dropped and subjected to impact. The bruising which occurs during sorting promotes spoilage and decreases the quality of the graded produce. Moreover, prior art devices are not readily adaptable for separating different types of vegetables without alterations in the machine structure.

Accordingly, the principle object of this invention is the provision of improved apparatus for separating objects such as fruits and vegetables according to size. Another object of the invention is to provide a sizing apparatus which reduces damaging and bruising of the sorted fruits and vegetables. A further object of the invention is to provide a sizing apparatus which is readily adaptable to different types of fruits and vegetables.

Other objects and advantages will become apparent by reference to the following description and drawings in which.

Figure 1:
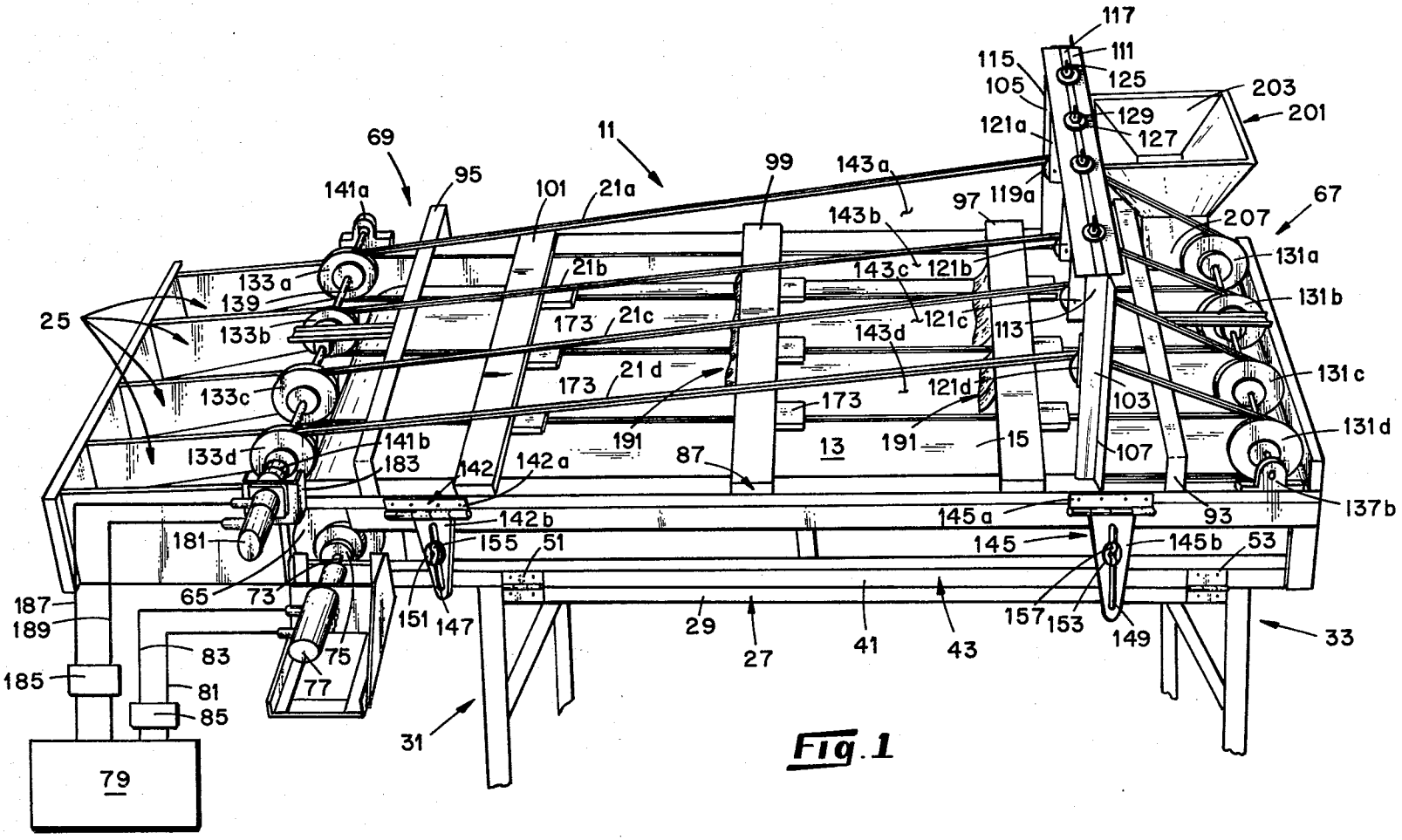
FIG. 1 is a perspective view of a sizing apparatus embodying various features of the invention.
Figure 2:
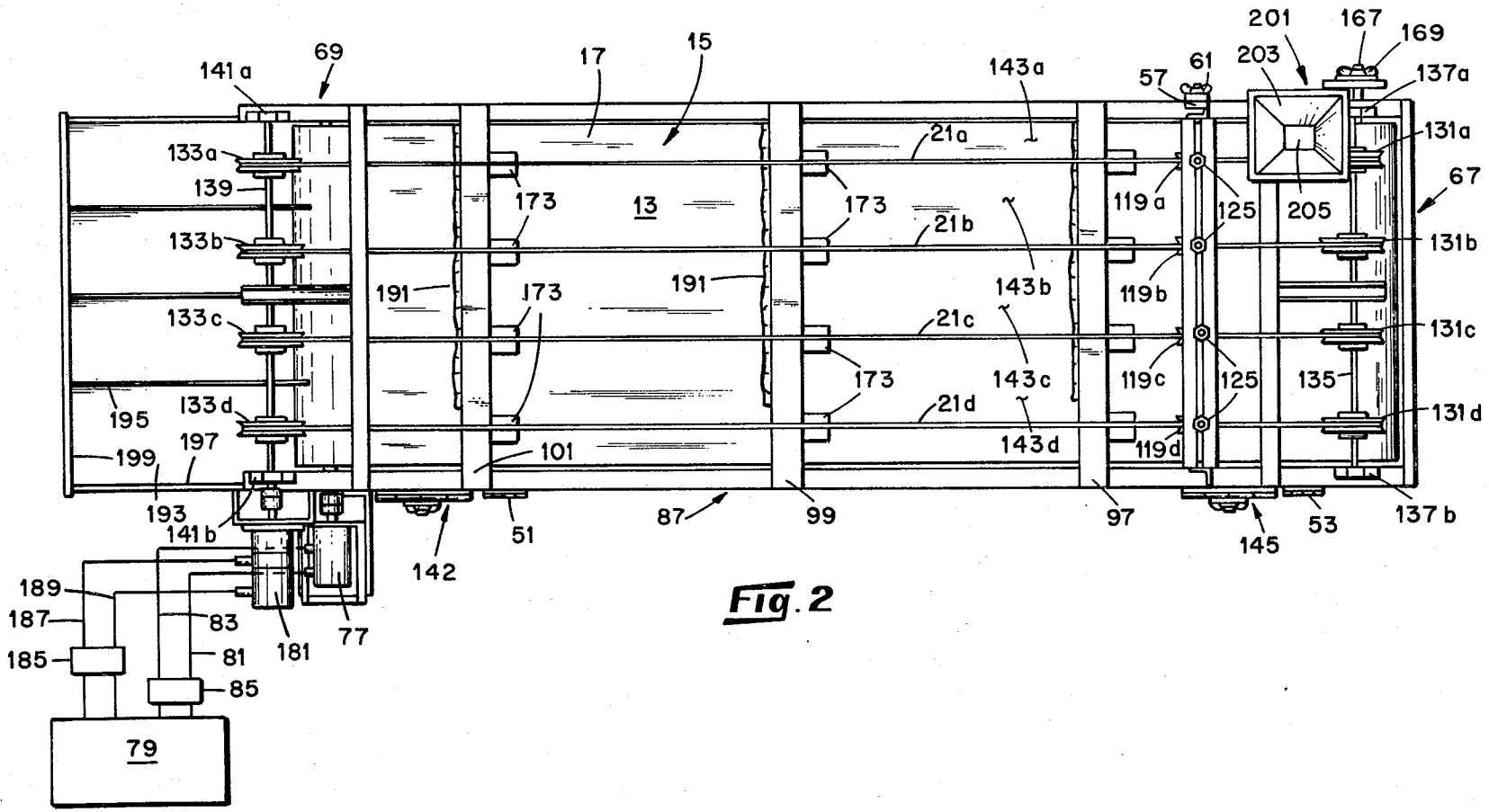
FIG. 2 is a plan view of the apparatus shown in FIG. 1.
Figure 3:
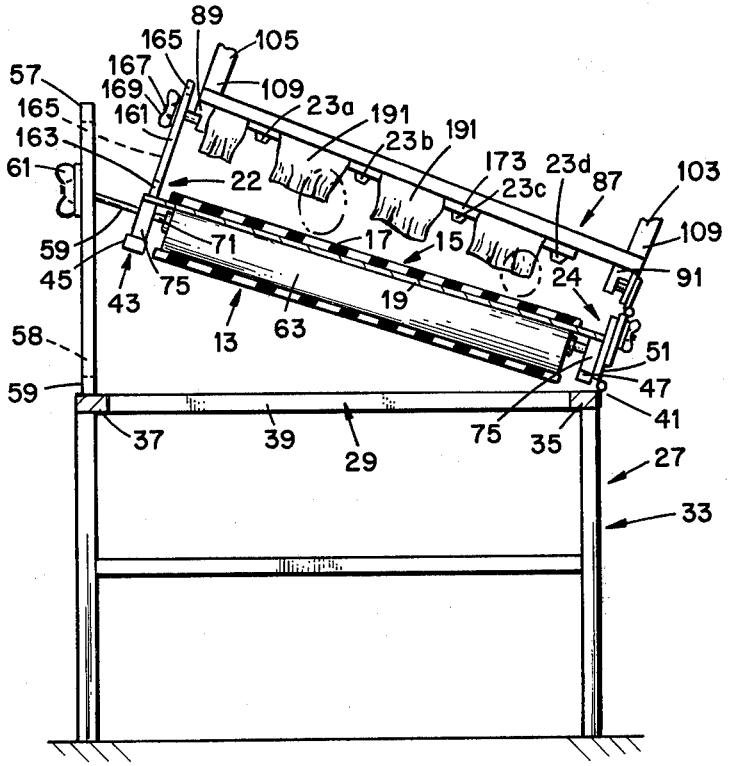
FIG. 3 is an exaggerated, fragmentary sectional view of the apparatus shown in FIG. 1.

In the illustrated embodiment, the separation of objects according to size is accomplished by a sizing apparatus 11 comprising conveyor means 13 including a conveyor belt 15 having an upper run 17 trained over an elongated supporting surface 19. The transverse slope of the conveyor means 13 is adjustable relative to the horizontal, whereby objects to be sized migrate transversely across the conveyor means under gravitational force. Means are provided for driving the conveyor belt for movement along the supporting surface 19. A plurality of endless sizing belts 21*a*, 21*b*, 21*c* and 21*d* are arranged in a side-by-side, spaced apart relationship with each sizing belt having a run 23*a–d*, respectively, which extends parallel to and longitudinally of the supporting surface 19. The distance between the sizing belt runs and the supporting surface or the surface of the upper run of the belt 15 varies from a maximum distance adjacent the uppermost edge 22 of the conveyor means 13 to a minimum distance adjacent the lowermost edge 24 of the conveyor means. Means are provided for driving the sizing belts at a predetermined speed so that the sizing belts and the conveyor belt may be adjusted or move at different speeds, as desired. In operation, objects to be sized are delivered to the sizing apparatus adjacent the uppermost edge of the conveyor means 13 and are sorted along the transverse dimension of the conveyor means 13 by the sizing belts as the objects migrate across the upper run 17 of the conveyor belt 15 under the force of gravity. A plurality of discharge channels 25 are located transversely across one end of the conveyor means 13 for collecting objects discharged by actuation of the conveyor belt 15.

In the illustrated apparatus, a base frame 27 is provided to support the conveyor means 13 and the sizing belts 21. The illustrated base frame 27 includes a generally horizontal table-like section 29 which is positioned at a desired height by spaced apart leg pairs 31 and 33 secured at their upper ends to the table section 29. The table section 29 includes elongated side members 35 and 37 which are joined at their opposite ends by cross members 39. The frame members may be provided with suitable reinforcing members (not shown). The base frame 27 may be fabricated from any appropriate structural members.

As pointed out above, in order that the objects being sized migrate across the conveyor means 13 is sloped or tilted. To this end, the conveyor means 13 is hingedly supported on the base frame 27 as will hereinafter be described. The conveyor means 13 includes an elongated frame 43 having spaced apart side members 45 and 47 extending longitudinally of the base frame 27. The supporting surface 19 is rectangular in outline and is connected at its marginal edges to the members 45 and 47, as by suitable webs or connections (not shown). The supporting surface 19 provides a flat surface over which the upper run 17 of the endless conveyor belt 15 is trained. The supporting surface 19 may be fabricated from a plate member, or it may comprise a grid or the like, the only requirement being that it provides a plane surface to maintain the upper run of the belt 15 flat. In order that the transverse slope of the conveyor means 13 can be adjusted, the members 35 on the base frame and the member 47 on the conveyor means 13 are hingedly connected together as by a pair of hinges 51 and 53.

Further, to adjust the transverse slope of the conveyor means 13 so that objects to be separated migrate across the conveyor belt 15 at a desired rate under the force of gravity, means are provided for maintaining the conveyor means 13 in a fixed pivotal position with respect to the table section 29 of the base fame 27. The illustrated means for securing the conveyor belt means at a desired transverse slope includes a substantially upright member 57 mounted at its lower end 59 on the elongated frame member 37 of the base frame 27. This upright member 57 includes an elongated slot 58 therein adapted for receiving one end portion of an externally threaded stud 59 secured at its opposite end to the conveyor frame 43. The transverse slope of the conveyor means 13 is adjusted by rotating the conveyor frame 43 about its hinged edge 41 until the desired slope is attained. A wing nut 61 is then screwed on the stud 59 to secure the uppermost edge 22 of the conveyor means 13 at the desired vertical displacement relative to the plane of the table section 29.

In order to convey the objects to be sized along the longitudinal dimension of the sizing apparatus 11, the endless conveyor belt 15 is trained about spaced apart rolls 63 and 65 mounted at the upstream or infeed end 67 and the discharge or downstream end 69, respectively, of the sizing apparatus. The rolls 63 and 65 are mounted on shafts 71 and 73, respectively, journaled at their opposite ends in suitable bearing blocks 75. The bearing blocks 75 are secured to the conveyor frame 43 at opposite ends of the frame members 45 and 47.

As pointed generally above, the upper run 17 of the conveyor belt 15 is supported along its length and width by a substantially rectangular supporting surface 19 which is secured along its side margins to members 45 and 47 of the conveyor frame 43. The supporting surface 19 assists in preventing vertical drift of the upper conveyor run 17 during operation of the sizing apparatus and provides a substantially rigid support for objects conveyed by the conveyor belt 15. In the illustrated embodiment, the conveyor belt 15 is a single wide belt. However, because of difficulty in training a wide belt about its rolls and maintaining the belt under tension it may be desirable to use other belt constructions such as a plurality of narrow belts placed in side-by-side relationship.

In order to move the conveyor belt 15 along the supporting surface 19 to convey objects to be sized from the infeed end 67 to the discharge end 69 of the conveyor means 13, means are provided for driving the belt 15. The illustrated motor means driving the belt 15 is a motor 77 mounted at the discharge end 69 of the conveyor frame 43 and coupled with the roller shaft 73 extending through the bearing block 75 at the discharge end of the sizing apparatus, as shown in FIG. 1. The illustrated motor is a hydraulic motor driven by hydraulic pressure source 79 illustrated in block form in FIG. 1. The hydraulic source 79 is connected to the conveyor motor 77 through conduits 81 and 83. The operation and speed of the motor 77 is controlled by control 85 interposed in the conduits 81 and 83 connecting the motor 77 with the hydraulic source 79. An advantage in the case of a hydraulic motor is that the sizing apparatus may be used in the field with the hydraulic fluid source being the hydraulic system on a tractor. If field use is not a consideration any suitable motor may be applied Objects migrating across the conveyor belt 15 are separated according to size by sizing belts 21*a–d.* The illustrated sizing belts are mounted on a sub-frame 87. The sub-frame 87 including a pair of elongated side members 89 and 91 which are joined at their opposite ends by elevated cross members 93 and 95 at the infeed and discharge ends 67, 69, respectively. Further cross members 97, 99 and 101 are secured at their opposite ends at spaced apart locations along the length of frame 87 to the side members 89 and 91, as shown in FIG. 1. This sub-frame 87 is hingedly mounted on the conveyor frame 43 as will be more fully described hereinafter.

The sizing belt sub-frame 87 further includes upright members 103 and 105 secured at their lower ends 107 and 109 to the elongated side frame members 89 and 91, respectively. A transverse frame member 111 extends between the upper ends 113 and 115 of the upright members 103 and 105 and includes an elongated opening 117. A plurality of sheaves 119*a, b, c,* and *d* are rotatably mounted in their respective clevises 121*a, b, c* and *d.* The clevis and roller structures are secured below the transverse frame member 111 by elongated externally threaded rods 125 having a lower end secured to the upper portion of a respective clevis and an upper end portion extending through the elongated opening 117 for receiving a washer 127 and a nut 129.

The endless sizing belts 21*a, b, c* and *d* are trained about sheaves 119*a, b, c* and *d,* infeed sheaves 131*a, b, c* and *d* and discharge sheaves 133*a, b, c* and *d* which maintain the sizing belts in substantially vertical planes during operation. In the illustrated embodiment, each of the infeed sheaves 131*a, b, c* and *d* is mounted on a shaft 135 at spaced apart locations along the shaft length. The opposite ends of the shaft 135 are journaled into suitable bearing mounts 137*a* and 137*b* on the opposite side members 89 and 91 of the sub-frame 87. Similarly, each of the discharge sheaves 133*a, b, c* and *d* are mounted on shaft 139 journaled at its opposite ends in suitable bearing mounts 141*a* and 141*b* on the discharge ends of sub-frame members 89 and 91. Each of the infeed sheaves and the discharge sheaves are keyed to their respective shafts to define sizing channels 143*a, b, c* and *d,* respectively. These sheaves are adjustable along the length of the shafts to define sizing channels 143*a–d* of the desired widths. In this connection, the rods 125 are adjustable along the length of the transverse member 111 to place the sheaves 119*a–d* in planar alignment with cooperating sheaves 131*a–d* and 133*a–d.* Moreover, the tension on the sizing belts 21*a–d* is adjustable by adjusting the vertical position of the sheaves 119*a–d,* respectively, relative to the transverse member 111.

In order that the distance between lower runs 23*a–d* of the sizing belts 21*a–d* vary from a maximum distance from the upper run 17 of the conveyor belt 15 adjacent the uppermost edge 22 of the conveyor means 13 to a minimum distance adjacent the lowermost edge of the conveyor means 13, the sub-frame member 91 and the conveyor frame member 47 are hingedly connected together as by a pair of hinges 142 and 145. It will be recognized that the spacing between the lower belt runs 21*a–d* and the conveyor belt run 17 are adjustable by varying the pivotal position of the sub-frame 87 with respect to the conveyor frame 43. As shown in FIG. 1, these hinges 142 and 145 include upper hinge plates 142*a* and 145*a* secured to the sub-frame member 91 and elongated lower hinge plates 142*b* and 145*b* secured to the conveyor frame 43. In order to adjust the vertical position of the sub-frame 87 with respect to the conveyor frame 43, the lower flaps 142*b* and 145*b* include slots 147 and 149 adapted for receiving bolts 151 and 153, respectively, secured to the conveyor frame. Suitable nuts 155 and 157 on the bolts 151 and 153, respectively, maintain a fixed displacement between the sub-frame member 91 and the conveyor frame member 47.

In order to maintain the lower sizing belt runs 23*a–d* at a fixed position relative to the supporting surface 19, means are provided for maintaining the sizing belt sub-frame 87 at a fixed pivotal position relative to the conveyor frame 43. The illustrated means for adjusting the displacement of the lower sizing belt runs 23*a–d* relative to the supporting surface 19 includes a substantially upright member 161 mounted at its lower end 163 on the elongated frame member 45 of the sizing belt sub-frame 87. This upright member 161 includes an elongated slot 165 therethrough adapted for receiving one end portion of an externally threaded shaft 167 secured at its opposite end to the sub-frame 87. The transverse slope of the sub-frame is adjusted by rotating the sub-frame 87 about its hinged edge until the desired slope is attained. A wing nut 169 is screwed on the shaft 167 to secure the frame member 89 at the desired vertical displacement relative to the plane of the supporting surface 19.

It will be recognized that different diameter sheave belt rollers may be used to adjust the separation between the supporting surface 19 and the lower belt runs. The disclosed means for adjusting the pivotal position of the sizing belt sub-frame 87 relative to the conveyor frame 43, however, enables rapid adjustment of the sizing apparatus to different types and grades of objects to be sized.

It will be recognized that objects migrating transversely across the conveyor belt 15 are separated according to size by the sizing belts 21*a, b, c* and *d.* To this end, the plurality of endless sizing belts 21*a–d* are arranged in a side-by-side and spaced-apart relationship above the upper belt run 17 and include lower runs 23*a–d* which extends longitudinally of the supporting surface to define the plurality of sizing channels 143*a–d* extending along the supporting surface from the infeed end 67 to the discharge end 69. In order to separate fruits or other objects migrating transversely across the upper run 17 of the conveyor belt 15, the distance between each of the lower sizing belt runs 23*a–d* and the conveyor belt run 17 varies from a maximum distance adjacent the uppermost edge 22 of the conveyor means 13 to a minimum distance at the lower-most edge 24 of the conveyor means 13. In this connection, the transverse migration of objects across the conveyor belt 15 is stopped when the dimension of the object is greater than the spacing between one of the lower belt runs 23*a–d* and the upper surface of the upper run of the conveyor belt 15. Since the movement of the object at this point across the supporting surface is restricted by the lower sizing belt run, and the force of gravity generated on the objects by the transverse slope of the supporting surface 19 maintains the object substantially adjacent the sizing belt which restricts its transverse movement, various sized objects are conveyed along the upper run 17 of the conveyor belt 15 along paths substantially adjacent to and above the sizing belt which prevents the transverse movement of the sized objects.

Figure 4:
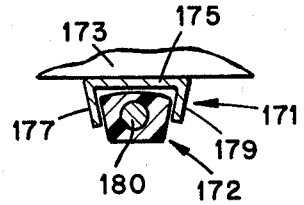
FIG. 4 is an enlarged fragmentary view of a belt guide which constitutes a part of the apparatus shown in the preceding Figures.

To assist in maintaining the lower runs 23*a–d* of the sizing belts 21*a–d,* respectively, at predetermined heights above the supporting surface 19 as objects pass under the belts, means are provided for guiding and preventing vertical and horizontal drift of the lower runs 23*a–d* of the sizing belts. The illustrated belt guides 171 are secured to cross members 173 fastened to the lower surface of cross members 97, 99 and 101 spaced apart along the longitudinal dimension of the sizing belt sub-frame 87. The illustrated guide 171 shown in FIG. 4 is adapted for guiding and preventing vertical and horizontal drift of a V-belt 172. To this end, the guide 171 defines a trapezoidal cross-section having an upper portion 175 from which depend inwardly sloping sides 177 and 179 which prevent downward and horizontal drift of the V-belt.

The illustrated V-belt 172 is preferably fabricated from a suitable substantially non-elastic core 180 such as a metal cable and covered with an elastomeric material such as polyethylene adapted to minimize the bruising of produce guided longitudinally along the conveyor belt 15. A suitable round belt or belt with an alternative shape may be used as desired to further assist in preventing damage to the objects to be separated. A specially constructed belt is not required, however, since standard V-belts provide satisfactory results under most conditions.

Means are provided for driving the sizing belts at a predetermined speed. The illustrated driving means comprises a hydraulic motor 181 drivingly connected with the shaft 139 at the discharge end 69 of the sizing apparatus. The motor 181 is mounted on the sub-frame 87 adjacent the shaft 139 by a motor frame 183. Control means 185 interposed in conduits 187 and 189 leading from the sizing belt motor 181 to a hydraulic source 79 are provided for controlling the operation and speed of the motor 181. It will be recognized that the sizing belt motor 181 and the conveyor belt means motor 77 are provided with separate controls and may be operated at different predetermined speeds. It has been found that operation of the sizing belts 21*a–d* and the conveyor belt 15 at different speed assists in preventing damage or bruising of the vegetables separated. Moreover, the conveyor belt 15 and the sizing belt means 21 may be driven in opposite directions to enhance the agitation of the objects to be sized relative to the sizing belts 21*a–d* to assist in preventing damage of the sized objects.

In order to assist in preventing smaller fruits and vegetables from being discharged at the discharge end 69 of the conveyor means 13 before drifting laterally and engaging the lower run of one of the sizing belts 21*a–d* spaced from the conveyor run 17 by a distance commensurate with the dimension of the object, deceleration means are spaced apart along the longitudinal dimension of the conveyor belt 15 and mounted intermediate the sizing belt runs. The illustrated deceleration means comprise a plurality of flexible flaps 191 which depend from the lower surface of the cross members 97, 99 and 101 and extend transversely across the conveyor belt 15. The flaps 191 impede the longitudinal movement of the objects to be sorted so that the transverse force exerted on the objects by gravity will cause the objects to migrate to a sizing belt having a run spaced above the conveyor belt run 17 by a distance commensurate with the dimension of an object perpendicular with the plane of the supporting surface 19.

The sorted objects are discharged from the end 69 of the sizing apparatus 11 into one of a plurality of discharge channels 25 aligned with the sizing channels 143*a–d* extending longitudinally of the supporting surface. Each of the illustrated discharge channels 25 are provided with a base section 193, opposed side panels 195 and 197, and a rear panel 199 to define a plurality of bins for collecting the sorted objects. As desired, however, continuous operation of the sizing apparatus without interruption of the separation operation for purposes of collecting the objects being sized.

In order that each object to be sorted migrates transversely across the conveyor belt means beneath each of the sizing belts spaced from the upper run 17 of the conveyor belt 15 by a distance greater than the dimension of the object until the transverse migration of the object is terminated by a sizing belt having a run spaced from the upper run 17 by a distance less than the dimension of the object, the objects to be sized are deposited on the endless conveyor belt means adjacent the infeed end 67 of the supporting surface at the uppermost edge 22 of the conveyor means 13. To this end, an infeed means 201 is secured to the sizing belt sub-frame 87 as shown in FIG. 1. The illustrated infeed means includes a hopper 203 into which the objects to be sized are poured. The hopper 203 includes a discharge opening at its lower end 207 which is positioned above the infeed end of the upper conveyor belt run 17 adjacent the uppermost edge 22 of the conveyor means 13.

In operation, objects such as fruits or vegetables to be sized are placed in the hopper 201 and are deposited on the upper run 17 of the conveyor belt 15 adjacent the uppermost edge 22 of the conveyor means 13 at its infeed end. The objects migrate transversely across the conveyor means 13 under the force of gravity until the transverse migration of each object is stopped by the lower run of a sizing belt spaced vertically apart from the upper run of the conveyor belt 15 by a distance commensurate with the dimension of the object. Movement of the conveyor belt 15 and the sizing belts 21*a–d* at different speeds causes the objects touching the sizing belts to spin and expose various dimensions to the sizing belt which terminates the objects transverse migration across the conveyor belt. This spinning action and the resultant exposure of different dimensions to the sizing belts assists in assuring migration of the object to the proper sizing belt and consequent accurate grading. The sized objects are then conveyed along the longitudinal dimension of the sizing apparatus by the conveyor belt 15 and discharged into one of the discharge channels positioned in alignment with one of the sizing channels.

In one specific embodiment used in sorting apples, the longitudinal dimension of the supporting surface was seven feet and the transverse slope of the supporting surface was set at twenty degrees with respect to the horizontal. Four sizing belts were used and the slope of the sizing belt sub-frame with respect to the supporting surface was set so that the spacing between the lower sizing belt runs and the upper surface of the conveyor run across the supporting surface were 2 15/16, 2 ⅜, 2 and 1 ¾inches, respectively, beginning at the uppermost run and continuing toward and including the lowermost run. The conveyor belt means was driven at a speed of 150 feet per minute and the sizing belts were driven at a rate of 100 feet per minute. At these speeds, it was found that 2.16 bushels of apples could be separated according to size in 1 minute with minimal damage or bruising. Various speeds for the belts may be employed but somewhat slower speeds are desirable for vegetables such as tomatoes or bell peppers which bruise more easily.

This invention would be particularly suitable for use in grading produce such as apples, tomatoes or the like in the field thereby enhancing the produce market value. Moreover, the grading levels are readily adjustable to adapt the sizing of the produce to the market demand.

While a preferred embodiment has been shown and described, it will be understood that there is no intent to limit the invention by such disclosure, but rather, it is intended to cover all modifications and alternative constructions falling within the spirit and scope of the invention as defined in the appended claims.

What is claimed is:

1. Apparatus for separating objects according to size comprising conveyor means including an elongated supporting surface, means for positioning said supporting surface with its transverse dimension at a slope to the horizontal, endless conveyor belt means having a run supported on said surface for movement therealong from one end of said supporting surface to the opposite end of said supporting surface, means for driving said conveyor belt means at a predetermined speed; a plurality of endless sizing belts arranged in side-by-side, spaced-apart relationship, each sizing belt having a run which extends generally longitudinally of said supporting surface, said sizing belt runs being disposed above and being substantially parallel to said supporting surface, the distance between each of said sizing belt runs and said supporting surface varying from a maximum distance adjacent the uppermost side of said conveyor means to a minimum distance adjacent the lowermost edge of said conveyor means, means for driving said sizing belts at a predetermined speed, means for depositing the objects to be sized on said endless conveyor belt means adjacent said one end of said supporting surface and adjacent the uppermost edge of said conveyor means along said slope and a plurality of discharge channels located transversely across said conveyor belt means at said other end of said supporting surface.

2. Apparatus, as defined in claim 1, including first frame means, means hingedly connecting one side of said conveyor means to said frame means, second frame means for supporting said sizing belts, means for hingedly supporting said second frame means for hinged movement relative to said conveyor means, whereby the slope of said supporting surface can be varied relative to the horizontal and the angle of said second frame means can be varied relative to said supporting surface.

3. Apparatus, as defined in claim 2, wherein means is provided for maintaining the position of said conveyor means relative to said first frame means and means is provided for maintaining the position of said second frame means relative to said supporting surface.

4. The apparatus, as defined in claim 1, wherein guide means are provided at spaced points along said sizing belt runs to maintain a substantially parallel relationship between each of said runs and said supporting surface.

5. Apparatus, as defined in claim 1, wherein decelerator means are positioned intermediate said sizing belt runs to engage the objects being sized.

6. Apparatus, as defined in claim 1, wherein said sizing belts include an elastomeric coating.

7. Apparatus, as defined in claim 1, wherein said sizing belts are driven at a first predetermined speed and said conveyor belt means is driven at a second predetermined speed which is different than said first predetermined speed.

* * * * *